US008513512B2

(12) United States Patent
Willacy et al.

(10) Patent No.: US 8,513,512 B2
(45) **Date of Patent: *Aug. 20, 2013**

(54) PERSONALIZED MUSIC REMIXING

(75) Inventors: Louis S. Willacy, Oakland, CA (US); Randy Locklair, Brooklyn, NY (US)

(73) Assignee: Funk Machine Inc., Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/459,182

(22) Filed: Apr. 29, 2012

(65) Prior Publication Data

US 2012/0210844 A1 Aug. 23, 2012

Related U.S. Application Data

(63) Continuation of application No. 12/257,382, filed on Oct. 23, 2008, now Pat. No. 8,173,883.

(60) Provisional application No. 60/982,347, filed on Oct. 24, 2007.

(51) Int. Cl.
*G10H 7/00* (2006.01)

(52) U.S. Cl.
USPC ..... 84/601; 84/612; 84/636; 84/652; 84/668

(58) Field of Classification Search
USPC ..... 84/600–602, 610–612, 634–636, 84/650–652, 666–668
See application file for complete search history.

(56) References Cited

U.S. PATENT DOCUMENTS 4,930,390 A * 6/1990 Kellogg et al. ..... 84/611
5,569,038 A * 10/1996 Tubman et al. ..... 434/308
6,067,566 A * 5/2000 Moline ..... 709/219
6,215,059 B1 * 4/2001 Rauchi et al. ..... 84/611
6,433,266 B1 * 8/2002 Fay et al. ..... 84/609
6,686,531 B1 * 2/2004 Pennock et al. ..... 84/615
7,078,607 B2 * 7/2006 Alferness ..... 84/609
7,208,672 B2 * 4/2007 Camiel ..... 84/625
7,525,036 B2 * 4/2009 Shotwell et al. ..... 84/611
7,563,975 B2 * 7/2009 Leahy et al. ..... 84/619
7,842,874 B2 * 11/2010 Jehan ..... 84/609
7,902,446 B2 * 3/2011 Humphrey ..... 84/470 R
2004/0069123 A1 * 4/2004 Becker et al. ..... 84/612
2004/0159221 A1 * 8/2004 Camiel ..... 84/660
2004/0244565 A1 * 12/2004 Cheng et al. ..... 84/610
2005/0132293 A1 * 6/2005 Herberger et al. ..... 715/723
2006/0075887 A1 * 4/2006 Shotwell et al. ..... 84/645
2006/0180007 A1 * 8/2006 McClinsey ..... 84/645
2007/0107585 A1 * 5/2007 Leahy et al. ..... 84/616
2007/0137463 A1 * 6/2007 Lumsden ..... 84/603
2008/0127812 A1 * 6/2008 Sako et al. ..... 84/625
2009/0107320 A1 * 4/2009 Willacy et al. ..... 84/609
2010/0011941 A1 * 1/2010 Becker et al. ..... 84/612
2010/0064882 A1 * 3/2010 Miyajima et al. ..... 84/625
2010/0186578 A1 * 7/2010 Bowen ..... 84/612
2010/0250510 A1 * 9/2010 Herberger et al. ..... 707/705

* cited by examiner

*Primary Examiner* — David S. Warren
(74) *Attorney, Agent, or Firm* — David L. Fligor

(57) ABSTRACT

A personal music mixing system with an embodiment providing beats and vocals configured using a web browser and musical compositions generated from said beats and vocals. Said embodiment provides a plurality of beats and vocals that a user may suitably mix to create a new musical composition and make such composition available for future playback by the user or by others. In some embodiments, the user advantageously may hear a sample musical composition having beats and vocals with particular user-configured parameter settings and may adjust said settings until the user deems the musical composition complete.

26 Claims, 3 Drawing Sheets

PERSONALIZED MUSIC REMIXING

CROSS REFERENCE TO RELATED APPLICATIONS

This application is a continuation of U.S. application Ser. No. 12/257,382, filed 23 Oct. 2008, now U.S. Pat. No. 8,173,883, issued 8 May 2012, which claims the benefit of U.S. Provisional Application Ser. No. 60/982,347, filed 24 Oct. 2007.

COPY RIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates generally to the field of remixing and playback of sound recordings and more particularly to such remixing and playback using tools designed for social networking and other websites on the Internet.

Individuals are increasingly turning to sites on the World Wide Web (the web) for information, shopping, entertainment, communication and community. Fast growing social network services such as MySpace and Facebook offer those individuals an outlet for expressing themselves to selected friends or to the world at large. Such websites and web services allow users to customize their personal profile pages by posting text, images, audio and video. Such social networking services also permit users to embed mini-web applications of their choice known as web widgets in personal profile pages. Web widgets allow users to further customize a personal profile page, blog, website, etc. by extending the functionality of the web widget to the personal profile page, blog or website. Web widgets related to music such as the iLike™ web widget from iLike, Inc. permit users to play clips of music they like on their Facebook personal profile page, show concerts they are attending and play a music trivia quiz.

Traditional ways of permitting consumers to experience music include making available copies of music in physical or digital form, live performances by the musicians, public performances of the music in nightclubs by disk jockeys, or karaoke machines in karaoke bars or at home. Due to a variety of factors, including difficulty in preventing unauthorized distribution of digital copies of music, there exists a need to engage consumers with music in new ways. One such new way of permitting users to experience and discover music include use of a web widget such as the iLike application referenced above, but such web widgets have the significant disadvantage of being static representations of music. A user who would like to hear a rearrangement of a particular song must wait until the record label releases a remixed version of the song.

In U.S. Pat. No. 7,078,607, Alferness proposed software tools for recording engineers to specify where in a particular song alternate recordings of an instrument (for example, alternate guitar solos) may appear in the song along with the ability to present a plurality of remixed versions of the song to the end user based on pre-programmed conditions. Although such approach may provide the end user with multiple remixed versions of a song, it suffers from, among other things, the significant disadvantage of not permitting end users to remix music themselves. The approach also requires complex determinations by the recording engineer in selecting alternate recordings of individual musical instruments and determining the appropriate conditions under which a particular remix will be presented to the end user. This approach further suffers from the significant disadvantage that the end user does not control which remix is presented to her and cannot personalize it to her individual tastes.

Others have proposed allowing users to rearrange isolated instrument and vocal recordings in a digital music file (U.S. Pat. Nos. 6,686,531 and 7,232,949). These proposals require specialized equipment or software; require significant music background; are difficult to use; or some or all of the foregoing. Further, none of the prior proposals are well suited to social networking services.

BRIEF SUMMARY OF THE INVENTION

The present invention allows individuals without significant music background to produce their own remixed versions of music and make the remixes available to others. Embodiments of the present invention is designed to operate efficiently and effectively in a web environment, particularly in a web environment that incorporates user-generated content and messaging capability, sometimes referred to as Web 2.0. Because the present invention is directed toward music remixing and playback by a wide population of consumers, various embodiments of the invention permit different degrees of freedom in rearranging musical compositions.

In a first embodiment of the invention, a music studio widget is provided on a website accessed with any standard web browser (e.g., Internet Explorer, Firefox). The music studio widget preferably allows a user, hereafter referred to as a producer, to select from a group of instrumental tracks, popularly referred to as "beats," and a corresponding group of vocal tracks, or "vocals." Once the producer has selected a beat and a vocal, the producer is provided the option to hear the beat and vocal played back simultaneously. The simultaneous playback of selected tracks is sometimes referred to as a remix. According to a first embodiment of the invention, sliders or other controls are provided that allow the producer to adjust characteristics of each track. Preferably, the music studio widget provides the producer the options of adjusting the volume and tempo of each of the beat and vocal tracks. Upon making any adjustment, the producer is provided the ability playback a new remix with the updated volume and tempo parameters. Finally, the producer is provided the option to transmit the resulting remix to the provider of the web service, hereinafter, a service provider, where the remixed song may be encoded into a full length, high quality digital music file for subsequent streaming or download. The end result is made available by the service provider to the producer, the producer's friends or all visitors to a particular website or personal profile page. The service provider may derive revenue from such streaming or downloading and may share any such revenue with various stakeholders.

The beats and vocals that are presented share common tempo and rhythm characteristics. An employee or agent of the service provider preferably determines which beats and vocals may be combined by producers with the music studio widget. Although the tempo of a particular track may vary within a song, some musical genres such as hip hop and techno generally maintain the same tempo.

In an alternative embodiment, matching logic may be used to automatically present beats and vocals in the music studio widget. The matching logic preferably employs widely available recording studio software such as OTSAV™ from OTS Labs Pty Ltd to determine the beats per minute (BPM) of each track and then matches beats and vocals with BPM characteristics within an acceptable range.

In either of the foregoing embodiments of the invention, the music studio widget preferably provides only a preview of the entire remix such as a 30 second sample. Providing a limited preview has several advantages, including improving the producer's experience by making the music studio widget faster. To experience the entire remixed song, a service provider server encodes the remix into a single digital music file for subsequent streaming or downloading.

Independent artists may upload beats and/or vocals onto the service provider's website using any well known file upload technique. Alternatively, a record label may provide the service provider with beats and vocals for one or more of its artists. A record label may desire to provide such tracks for free to promote an upcoming album release or a concert. Alternatively, the record label may contribute such tracks in order to recognize revenue from sales of remixes.

Embodiments of the present invention provide significant advantages to independent artists and record labels by providing tools to support a large number of licensing models. As an example, each time a particular remix is purchased and downloaded, the individual or entity with rights to the instrumental and vocal tracks, the individual who created the remix and the service provider may share in revenue from the purchase. Alternatively, remixed songs may be placed on physical media such as compact disks and sold through traditional outlets or songs may be streamed for free on advertising-supported websites with revenue shared among any number of individuals or entities (e.g., artists, producers, record labels, service providers, website operators, retailers, affiliates, etc.) Finally, remixed songs may be streamed to any number of users simultaneously using conventional streaming techniques.

Another aspect of the present invention permits users to collaborate with other users in a unique way. Upon selection of a particular instrumental or vocal track by a producer, the producer and the supplier of the particular track are automatically linked as "friends" through a social networking service. By identifying users as friends, or allowing them to self-identify as friends, the users maintain social interaction and collaborate on any number of remixes or otherwise discuss music and build community. Linking users as friends may be accomplished using a number of methods known to individuals of ordinary skill in the art, including storing pointers from a particular individual's user name to the user names of all of that individual's "friends" within a database. Still other aspects of embodiments of the present invention allow producers and other visitors to a website or personal profile page to rate particular instrumental or vocal tracks and/or remixes or identify them as favorites.

Yet another aspect of the present invention allows the producer to use a music studio widget to overlay sound effects such as scratches or optional instrumental tracks such as guitar solos to be inserted in particular locations of a song. Yet other aspects of the present invention provide the producer with the ability to crop or delay the instrumental and/or vocal tracks while constructing a remix. Still further aspects of the present invention permit the producer to visualize the beats and vocals during audible playback using the music studio widget. Finally, another aspect of the present invention provides the user the ability to adjust the overall volume, tempo or other characteristics of the remix during playback.

A further understanding of the nature and advantages of the present invention may be realized by reference to the remaining portions of the specification and the attached drawings. Further features and advantages of the present invention, as well as the structure and operation of various embodiments of the present invention, are described in detail below with respect to the accompanying drawings, in the drawings, the same reference numbers indicate identical or functionally similar elements.

DETAILED DESCRIPTION OF THE INVENTION

Reference will now be made in detail to exemplary embodiments of the invention, examples of which are illustrated in the accompany drawings. While the invention will be described in conjunction with the exemplary embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to a person of ordinary skill in the art that the present invention may be practiced without these specific details. In other instances, well known methods, procedures, components, and circuits have not been described in detail as not to unnecessarily obscure aspects of the present invention.

Figure 1:
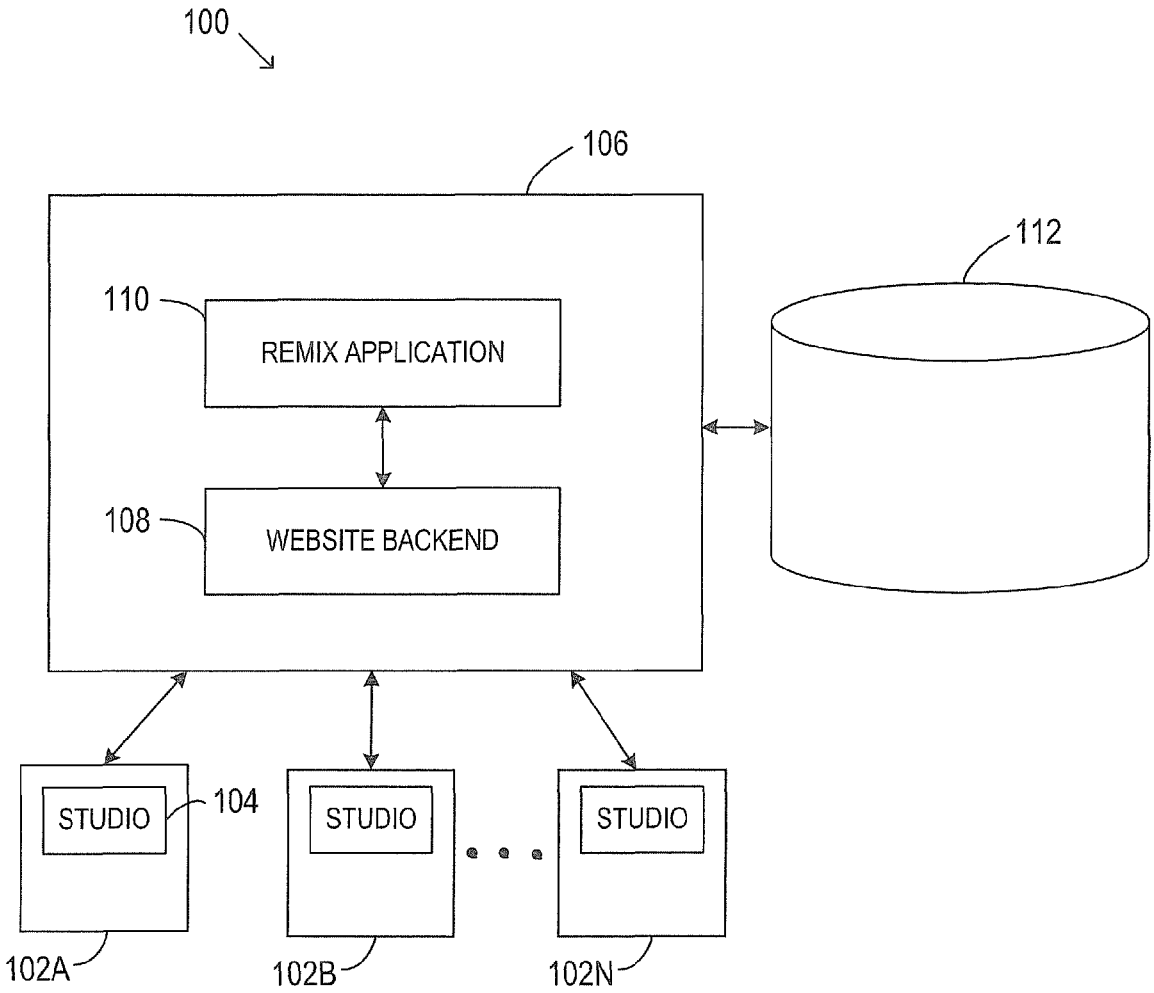
FIG. 1 is a block diagram showing the main components of a personalized music remixing system 100 according to an exemplary embodiment of the invention.

FIG. 1 is a block diagram showing the main components of a personalized music remixing system 100 according to an exemplary embodiment of the invention.

In FIG. 1, personalized music remixing system 100 is comprised of one or more computers 102A, 102B through 102N, server 106 and database 112. Each of the computers 102A, 102B through 102N is in communication with server 106 via a network (not shown). The network may be any private or public network, and server 106 preferably is connected to the computers 102A, 102B, etc. via the Internet.

Computers 102A, 102B through 102N are preferably off-the-shelf personal computers running any standard web browser application such as Microsoft Internet Explorer or Mozilla Firefox (not shown). Each of computers 102A, 102B through 102N alternatively may be any computing device, mobile phone, personal digital assistant (PDA) that is capable of browsing web pages. Using the web browser application of computer 102A, the end user (also referred herein as the producer), navigates to a web site or personalized profile page with music studio widget 104.

In personalized music remixing system 100, music studio widget 104 is an application created with a standard multimedia authoring program such as Adobe Flash. Server 106 is a computing device running a standard web server with website backend 108 and a remix application 110. Website backend 108 in this exemplary embodiment is written using the PHP scripting language. Website backend 108 may alternatively be written using any server-side scripting language such as Microsoft's ASP.NET or Sun Microsystems' JavaServer Pages (JSP). Remix application 110 may be implemented using the C programming language or any other programming language for the purposes described below. Server 106 is coupled to a database 112 that includes digital representations of beats, vocals and complete songs, which may be remixes of beats and vocals with particular parameters such as volume and tempo specified for the beats and the same parameters specified for the vocals. Database 112 may be within server 106 or in a separate machine connected to server 106. In other embodiments, database 112 is omitted and server 106 stores all such information in any suitable data structure using any convenient storage medium.

Music studio widget 104 is used by a producer to create, preview and finalize remixes comprised of beats and vocals available from the service provider's website. As the producer edits user-configurable parameters for beats and vocals, requests are sent to website backend 108 to produce previews of the new remix. Upon receipt of a request, website backend 108 invokes remix application 110 to create a 30 second remix preview and passes values for user-configurable parameters (such as volume and tempo) for the selected beat and values for the same parameters for the vocal. Remix application 110 executes a series of digital signal processing (DSP) routines to time-stretch and amplify each track (in other words, the beat and the vocal) in accordance with the parameter values. Once each track is time-stretched and amplified, the tracks are mixed and compressed into a standard digital music format such as MP3. Remix application 110 places the mixed and compressed file into database 112 and notifies website backend 108 that the file is ready. Website backend 108 then supplies music studio widget 104 with the preview of the remix. By limiting the preview to 30 seconds, personalized music remixing system operates quickly because the amount of data the remix application has to process is limited. In the exemplary embodiment, remix application 110 is designed to create previews that are more compressed than a typical full quality MP3 file, further increasing efficiency of personalized music remixing system 100. Although not shown, additional components of songs may be included, including but not limited to additional vocal tracks (e.g., foreground vocals and background vocals) and additional instrumental tracks (e.g., separate tracks for each instrument). Also not shown, additional user-configurable parameters may be provided depending on available DSP routines.

Software code to implement remix application 110 in an exemplary embodiment of personalized music remixing system 100 is as follows:

```
// step 3: resample and write audio data
double dSpeedPct = atof(argv[3]);
if (dSpeedPct!=100.0)
  {
    char *vpTargetBuffer;
    int iTBLen;
    int iSCOriginal, iSCTarget;
    double dSamplePosition, dSampleDelta;
    if (iVerbose) printf("studio: resampling...\n");
    iSCOriginal = iSourceDataLength/4;
    iSCTarget = (int)((double)iSCOriginal * 100.0 / dSpeedPct);
    iTBLen = iSCTarget * 4;
    vpTargetBuffer = (char *)malloc(iTBLen);
    dSampleDelta = (double)iSCOriginal / (double)iSCTarget;
    {
      int iCur, iNSPos, iCS;
      iCS = (iSCDelay / (iSCDelay + iSCTarget)) * 354;
      iNSPos = iSCTarget/354 * iCS;
      dSamplePosition = 0;
      for (iCur=0;iCur<iSCTarget;iCur++)
      {
        vpTargetBuffer[(4*iCur+0)] = vSourceData[(4*(int)dSamplePosition) + 0];
        vpTargetBuffer[(4*iCur+1)] = vSourceData[(4*(int)dSamplePosition) + 1];
        vpTargetBuffer[(4*iCur+2)] = vSourceData[(4*(int)dSamplePosition) + 2];
        vpTargetBuffer[(4*iCur+3)] = vSourceData[(4*(int)dSamplePosition) + 3];
          if (iCur==iNSPos)
          {
            short sLeft, sRight;
        sLeft = vpTargetBuffer[(4*iCur+0)] + (256*vpTargetBuffer[(4*iCur+1)]);
        sRight = vpTargetBuffer[(4*iCur+2)] + (256*vpTargetBuffer[(4*iCur+3)]);
      asSamples[iCS] = (short)abs(sLeft + sRight / 2);
            if (asSamples[iCS] > sMax)
            {
              sMax = asSamples[iCS];
            }
            iCS++;
            iNSPos += iSCTarget/354;
          }
          dSamplePosition += dSampleDelta;
        }
      }
      write(iFD, vpTargetBuffer, iTBLen);
    }
```

© 2007 Funk Machine Inc.

After hearing the preview (or a portion of the preview) played back through speakers associated with computer 102A using music studio widget 104, the producer may either select different parameters (e.g., tempo or volume) for the selected beat and/or vocal. Alternatively, the producer may select a different beat and/or vocal. In either case, the personalized music remixing system continues to operate as described above until the user submits a request to website backend 108 to finalize and save a remix. Upon receipt of such request, website backend 108 invokes remix application 110 to create a full quality, full length digital music file using the selected tracks and the supplied parameters. Upon completion, the remix application places the full quality, full length digital music file into database 112 and notifies website backend 108. Website backend 108 notifies music studio widget 104 that the file has been saved. Thereafter, the producer's remix may be made available via the service provider's website for later streaming or downloading by the producer or any other user (e.g., friends of the producer, fans of the artists, etc.).

Figure 2:
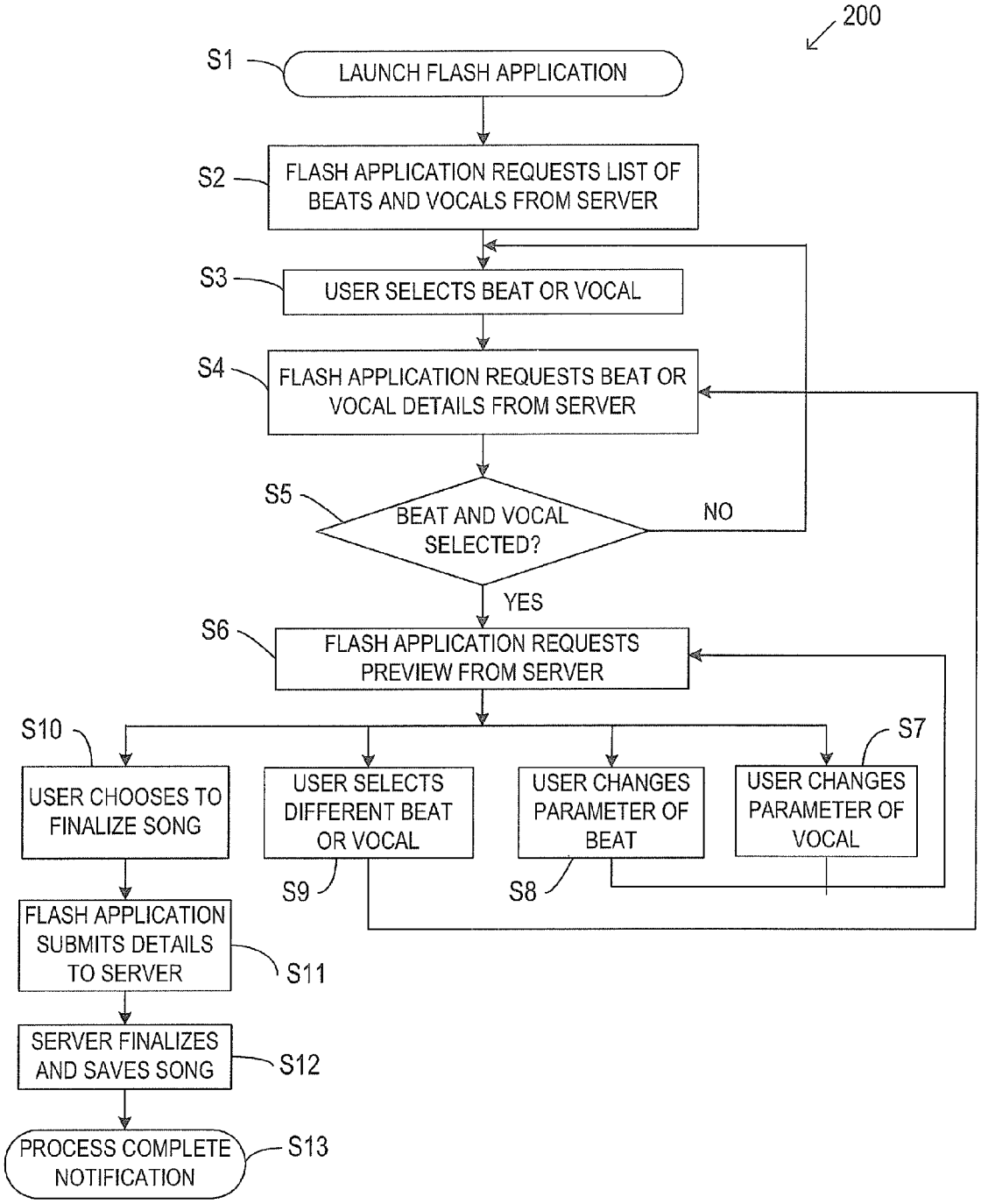
FIG. 2 is a flowchart of a method 200 of the present invention according to an exemplary embodiment of the invention.

FIG. 2 is a flowchart of a method 200 of the preset invention according to an exemplary embodiment of the invention.

Upon launching the music studio widget 104 in step S1, the music studio widget 104 sends a request to server 106 for a list of available beats and vocals in step S2. Server 106 receives the request from music studio widget 104 and passes the request to website backend application 108. Upon receipt of the request for a list of available beats and vocals, website backend 108 retrieves titles of beats and vocals. In some embodiments, all available beats and vocals are presented. In other embodiments, only beats and vocals with particular characteristics are presented. The service provider may have pre-selected beats and vocals using criteria determined by the service provider or the artists or record labels, or any combination of the foregoing. Alternatively, the available beats and vocals may be determined based on matching logic that identifies particular tracks as having similar characteristics (e.g., tempo characteristics of each track within 0.5 BPM). All beats and vocals may initially be presented and upon producer selection of a track (a beat or a vocal), only a subset of tracks are presented.

Website backend 108 responds to music studio widget 104 with titles of beats and vocals. In step S3, the user selects a beat or a vocal. In step S4, music studio widget 104 requests file information including default volume and tempo parameters for the selected beat or vocal, which are supplied by the website backend 108 after retrieval from database 112. In this exemplary embodiment, a check is performed in step S5 to determine whether both a beat and vocal have been selected. If not, the music studio widget 104 returns to step S3 and the user selects the other track (in other words, a vocal if the user first selected a beat or a beat if the user first selected a vocal). Step S4 is repeated for selected track (i.e., the music studio widget 104 requests file information including default volume and tempo parameters for the selected track). A check is performed in Step 5 again to confirm that both a beat and vocal have been selected. If so, the music studio widget 104 requests a remix from the server 106 using the default parameters for each of the beat and vocal. As an example, each track may be assigned a default value for volume and tempo. In an alternative embodiment, the server 106 may dynamically adjust values for volume and tempo based on the selected tracks, based on the default values of either of the selected tracks or any combination of the foregoing. In step S6, website backend 108 and remix application 110 generate a preview of the remix as described in relation to FIG. 1 above and the producer is permitted to play the preview using music studio widget 104. At this point, the producer is provided with several options. The user may choose to select a different beat or vocal, indicated as S9 in FIG. 2, steps in S4 through S6 are repeated and a new preview is generated. Alternatively, the producer may change a parameter associated with the previously selected vocal (shown as S7) or a parameter associated with the previously selected beat (shown as S8). In either case, step S6 is repeated and a new preview is generated. If the producer chooses to finalize the remix (step S10), music studio widget 104 submits the selected tracks and user-configured parameters to server 106 (step S11). In step S12, the website backend 108 in server 106 invokes the remix application 110 to generate the full quality, full length version of the remix and save the remix to database 112. Finally, in step S13, upon completion of the final remix, the website backend notifies the producer that the process is complete as described in relation to FIG. 1 above.

In alternative embodiments, the producer may optionally use music studio widget 104 to play a selected beat or vocal with default parameters or with user modified parameters without choosing a corresponding vocal or beat.

In step S2 of FIG. 2, website backend 108 may be designed so that only particular beats and/or vocals will be displayed through music studio widget 104. For example, the service provider may determine that certain beats have rhythms that closely match certain vocals, but that particular combinations of beats and vocals will not produce satisfactory results. In an exemplary embodiment, the beats and vocals that are presented share common tempo and rhythm characteristics based on manual or automated analysis. An employee or agent of the service provider preferably determines which beats and vocals may be combined by producers with the music studio widget. In an alternative embodiment, matching logic may be used to automatically present beats and vocals in the music studio widget. The matching logic preferably employs widely available recording studio software to determine the beats per minute (BPM) of each track and then matches beats and vocals with BPM characteristics within an acceptable range. Because the human ear is sensitive to slight variations, the difference between BPM of the beat and BPM of the vocal is preferably less than 0.5 BPM. In this embodiment, the employee or agent of the service provider typically would listen to the candidates produced by the matching logic, each played back at normal speed and volume, to ensure that the matching logic produced an acceptable combination of tracks.

Figure 3:
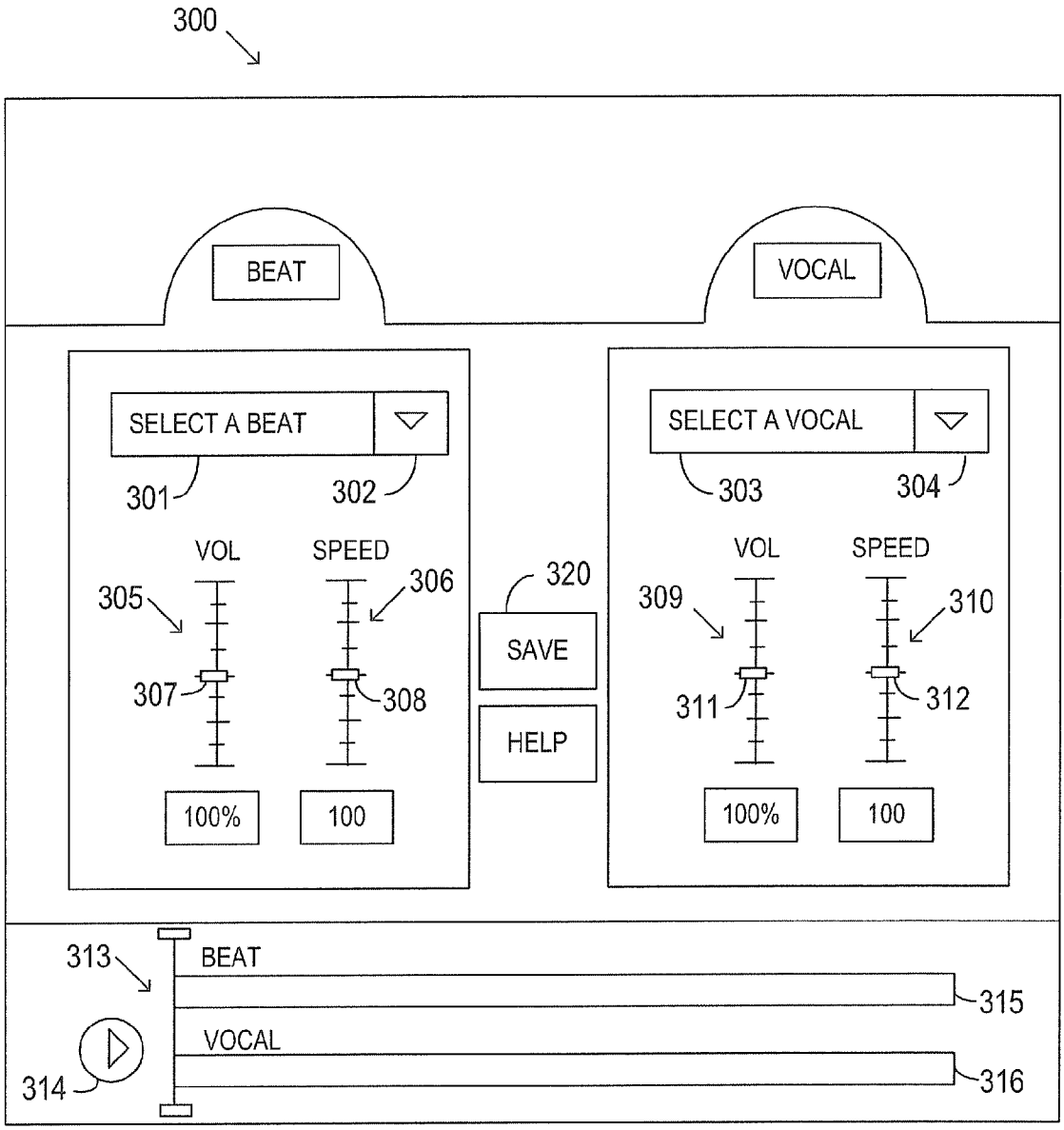
FIG. 3 shows a music studio widget 300 according to an exemplary embodiment of the invention.

FIG. 3 shows a music studio widget 300 according to an exemplary embodiment of the invention.

Music studio widget 300 of this exemplary embodiment is a Flash application with track title displays 301 and 303; drop down menus 302 and 304; sliders 305, 306, 309 and 310; position indicators 307, 308, 311 and 312; visual display 313; preview button 314 and save button 320. Visual display 313 is comprised of track displays 315 and 316.

Drop down menu 302 permits the producer to select a beat and drop down menu 304 permits the producer to select a vocal. Slider 305 permits the producer to alter the volume of the beat for the remix by adjusting position indicator 307 using a mouse, keyboard or any other suitable peripheral device. Slider 306 permits the producer to alter the speed, or tempo, of the beat for the remix by likewise adjusting position indicator 308. Similarly, slider 309 permits the producer to alter the volume of the vocal for the remix using position indicator 311 and slider 310 permits the producer to alter the speed, or tempo, of the vocal for the remix using position indicator 312. In this exemplary embodiment, these parameters are set at 100 by default, which represents 100% of the default volume and tempo. Preferably, the sliders permit adjustment by the producer of between 0% and 200% for volume and between 50% and 150% for speed. The permitted range for each parameter depends on the amount of freedom desired by the service provider or the artists or record labels supplying beats and vocals. Visual display 313 permits the producer to view visual representations, e.g., waveforms, of each selected track with the selected parameters during a preview of the remix, accomplished by pressing preview button 314. Track display 315 comprises the visual representation of the selected beat with default (or, alternatively, producer-selected) parameters and track display 316 comprises a visual representation of the selected vocal with default (or, alternatively, producer-selected) parameters. Upon requesting a preview with preview button 314, a preview is played through speakers associated with the device that is running the Flash application synchronous with such track displays. Save button 320 permits the producer to finalize a remix as described in relation to FIG. 2 above.

While the above is a complete description of exemplary specific embodiments of the invention, additional embodiments are also possible. Thus, the above description should not be taken as limiting the scope of the invention.

We claim:

1. A method for producing and distributing musical compositions over a network, comprising:

storing a plurality of beats, wherein said beats comprise recordings of a plurality of instruments;

storing a plurality of vocals, wherein said vocals comprise recordings of one or more human voices;

identifying a stored vocal that corresponds to a stored beat based an one or more characteristics of said stored beat and said stored vocal;

presenting an identification of said stored beat and an identification of said stored vocal;

generating an adjusted beat from said stored beat in response to a beat adjustment control command;

generating an adjusted vocal from said stored vocal in response to a vocal adjustment control command;

sending at least a portion of said adjusted beat and at least a portion of said adjusted vocal to a decoder for simultaneous playback of a candidate musical composition;

transmitting information corresponding to said adjusted beat and said adjusted vocal over a network; and compiling a musical composition from said information.

2. The method of claim 1, wherein identifying is performed using matching logic.

3. The method of claim 1, wherein the one or more characteristics are selected from the group consisting of tempo and rhythm.

4. The method of claim 1, wherein said adjusted beat is generated by time stretching said stored beat in response to said beat adjustment control command.

5. The method of claim 1, wherein said adjusted vocal is generated by time stretching said stored vocal in response to said vocal adjustment control command.

6. The method of claim 1, wherein said adjusted beat is generated by amplifying said stored beat in response to said beat adjustment control command.

7. The method of claim 1, wherein said adjusted vocal is generated by amplifying said stored vocal in response to said vocal adjustment control command.

8. The method of claim 1, wherein said adjusted beat is generated by time stretching and amplifying said stored beat in response to a plurality of beat adjustment control commands.

9. The method of claim 1, wherein said adjusted vocal is generated by time stretching and amplifying said stored vocal.

10. The method of claim 1, further including storing said musical composition for subsequent playback.

11. The method of claim 8, wherein said adjusted vocal is generated by time stretching and amplifying said stored vocal in response to a plurality of vocal adjustment control commands.

12. The method of claim 10, further including downloading said musical composition over a network.

13. The method of claim 10, further including streaming said musical composition over a network to a plurality of clients simultaneously.

14. A process for creating and distributing a musical composition over a network, comprising;

storing a plurality of tracks;

selecting a first track from said plurality of tracks;

selecting a second track from a subset of said plurality of tracks wherein matching logic determines said subset of said plurality of tracks by comparing the tempo of the first track and the respective tempo of each track within said plurality of tracks;

dynamically modifying said first track;

dynamically modifying said second track;

sending at least a portion of said modified first track and at least a portion of said modified second track to a decoder for simultaneous playback;

transmitting information regarding said modified first track and said modified second track over a network;

compiling a full length remix using such information;

storing said full length remix; and simultaneously streaming said stored full length remix over a network to a plurality of clients.

15. The process of claim 14, wherein modifying said first track comprises time stretching said first track in response to control commands.

16. The process of claim 15, wherein modifying said second track comprises time stretching said second track in response to control commands.

17. The process of claim 14, wherein modifying said first track comprises amplifying said first track in response to a control command.

18. The process of claim 17, wherein modifying said second track comprises amplifying said second track in response to a control command.

19. A process for producing musical compositions, comprising:

storing a plurality of tracks;

selecting a first track from said plurality of tracks;

selecting a second track from a subset of said plurality of tracks;

dynamically modifying said first track;

dynamically modifying said second track;

sending at least a portion of said modified first track and at least a portion of said modified second track to a decoder for simultaneous playback;

transmitting information regarding said modified first track and said modified second track over a network;

compiling a full length remix using such information; and storing said full length remix.

20. The process of claim 19, wherein said subset consists of tracks that have at least one characteristic in common with said first track.

21. The process of claim 19, further comprising streaming said stored full length remix over a network.

22. The process of claim 19, wherein modifying said first track comprises adjusting as user-configurable parameter of said first track.

23. The process of claim 22, wherein modifying said second track comprises adjusting a user-configurable parameter of said second track.

24. A method for producing musical compositions, comprising:

storing a plurality of beats, wherein said beats comprise recordings of a plurality of instruments;

storing a plurality of vocals, wherein said vocals comprise recordings of one or more human voices;

identifying a stored beat;

identifying a stored vocal;

adjusting said stored beat;

adjusting said stored vocal;

sending at least a portion of said adjusted beat and at least a portion of said adjusted vocal to a decoder for simultaneous playback of a candidate musical composition;

transmitting information corresponding to said adjusted beat and said adjusted vocal over a network; and compiling a musical composition from said information.

25. The method of claim 24, wherein adjusting said stored beat comprises modifying a user-configurable parameter of said stored beat.

26. The method of claim 25, wherein adjusting said stored vocal comprises modifying a user-configurable parameter of said stored vocal.

* * * * *